United States Patent [19]

Leitman

[11] Patent Number: 4,516,871

[45] Date of Patent: May 14, 1985

[54] TABULATED SHEET PROTECTORS

[76] Inventor: Ervin Leitman, 1682 53rd St., Brooklyn, N.Y. 11204

[21] Appl. No.: 403,128

[22] Filed: Jul. 29, 1982

[51] Int. Cl.[3] ..... B42F 13/00; B42F 21/00; B42F 21/02; B42D 17/00

[52] U.S. Cl. ..... 402/79; 281/46; 283/38; 283/40

[58] Field of Search ..... 281/38, 46; 283/18, 283/38, 40, 41, 42, 43, 48 R; 402/79

[56] References Cited

U.S. PATENT DOCUMENTS

| | | | |
|---|---|---|---|
| 1,018,459 | 2/1912 | Walker, Jr. | 402/79 |
| 1,172,010 | 2/1916 | Cooke, Jr. | 402/79 |
| 1,488,616 | 4/1924 | Robbins | 281/46 X |
| 2,303,671 | 12/1942 | Walraven | 283/38 |
| 2,509,841 | 5/1950 | Rose | 283/40 |
| 2,936,680 | 5/1960 | Copen | 402/79 |
| 2,986,144 | 5/1961 | Shepard | 283/38 |
| 3,324,823 | 6/1967 | Peters | 283/38 |

FOREIGN PATENT DOCUMENTS 367339 10/1959 Switzerland .

*Primary Examiner*—Paul A. Bell
*Assistant Examiner*—Paul M. Heyrana, Sr.
*Attorney, Agent, or Firm*—Abraham Friedman

[57] ABSTRACT

A sheet protector formed of upper and lower layers of substantially transparent plastic material. A pair of complementary tabs each laterally extending from the edges of the respective layers are integrally formed therewith. Heat sealing is utilized for securing together at least some of the peripheries of the layers as well as the matching tabs. An opening is provided to define in combination with the layers a receiving pocket whereby a sheet may be inserted in the pocket. A loose-leaf type binder is provided for holding a plurality of the sheet protectors. The tab positions of the respective sheet protectors in the binder are sequentially indexed with respect to each other to provide a set of position selectable sheet protectors.

11 Claims, 3 Drawing Figures

TABULATED SHEET PROTECTORS

BACKGROUND OF THE INVENTION

This invention relates to sheet protectors, and more particularly to a tabulated sheet protector for use in an indexed refillable book, as well as a method for making such sheet protectors.

There are many areas which require use of a tabulated, indexed, refillable book. For example, a telephone director typically utilizes a series of tabulated, indexed pages with the tabs being identified by the letters of the alphabet. The tabs generally extend laterally from the pages of the book so that they can be easily selected and the book opened to the proper page. Frequently, diaries also utilize such tabulated pages with the tabs being identified by the names or numbers of the months. Many other types of books similarly utilize tabulated pages including recipe books, calendars, credit card directories and numerous others.

Many of these tabulated books utilize a looseleaf type binder with rings for holding the tabulated pages. The rings can generally be opened to permit the addition and/or removal of individual pages from the book.

By way of example, in a telephone directory, there can be a number of sheets provided within the looseleaf book with a sheet having a column for inserting the name, address, and telephone number of various individuals. Laterally extending from each sheet will be a tab identifying the particular letter of the alphabet relating to those names. Additional sheets bearing the same letter can be added. Alternately, additional sheets without any tabs can be added behind a particular indexed sheet having a tab with an identifying letter.

When utilizing such books, the sheets must be accessible for adding new entries into the directory, such as adding additional names and addresses. At the same time, they must be durable so as to sustain continued turning of pages, regular usage, rubbing against the pages, and similar harsh treatment. Also, the sheets should be of a type which can be easily removed and replaced within the binder.

One solution is to utilize sheet protectors for protecting the individual sheets. The sheets can be inserted or removed from the sheet protectors for adding or removal of names. At the same time, once inserted into the sheet protectors, the sheet itself will be protected so that continuous usage will not damage the sheet. However, the difficulty with utilizing such sheet protectors is that they must be readily insertable into the binder and additional sheet protectors should be available for easy insertion and removal from the binder. Additionally, the problem arises as to how to provide the tabulation for the sheets. If the sheets themselves are tabulated, then the tabs will extend beyond the sheet protector and the tabs will be damaged. If the sheet protectors are tabulated, the tabs will have a tendancy to rip off, or be separated from the sheet protectors. Additionally, a difficulty arises in how to retain the tabs onto the sheet protectors to provide a permanent and yet not mar the sheet protector nor disturb the attractiveness of the book.

SUMMARY OF THE INVENTION

Accordingly, it is an object of the present invention to provide a tabulated refillable book which avoids the aforementioned problems of prior art books of a similar nature.

A further object of the present invention is to provide a tabulated refillable book having a plurality of sheet protectors with each sheet protector formed with an integral tab.

Still another object of the present invention is to provide a tabulated refillable book having a plurality of transparent sheet protectors with each sheet protector having a laterally extending integral tab and with the various respective positions of the tabs on each sheet being sequentially indexed. A further object of the present invention is to provide a sheet protector formed of upper and lower layers of substantially transparent plastic material to define a sheet receiving pocket therebetween, and having a pair of complementary tabs laterally extending and integral with each of the layers.

Another object of the present invention is to provide a sheet protector formed of upper and lower layers of plastic material each having a matching tab portion laterally extending and integral therewith with the layers being sealed together through heat sealing means with the heat seal engraving an identification indicia on the tab.

Yet another object of the present invention is to provide a method for forming a sheet protector with an integral tab portion.

A further object of the present invention is to provide a method of forming a sheet protector formed of two layers by heat sealing together the two layers and simultaneously engraving an identification indicia in the tab portion using the same heat sealing procedure.

Briefly, in accordance with the present invention, there is provided a sheet protector formed of an upper and lower layer of substantially transparent plastic material. A pair of complementary tabs are provided with each tab laterally extending from the edge of a respective layer and integrally formed with that layer. Heat seals are formed for securing together at least a portion of the peripheries of the layers and also for securing together the matching tabs. An opening is formed in the layers for defining in combination with the layers a suitable pocket whereby a sheet may be inserted in the pocket.

The present invention also contemplates a method of forming a sheet protector by first obtaining an upper and lower layer of substantially transparent plastic material with each layer having an integral matching tab laterally extending from an edge thereof. The layers are then heat sealed together to that at least a portion of the peripheries of the layers are secured as well as the matching tabs being secured together.

An access is provided into the space between the layers to define a pocket whereby a sheet may be inserted into the pocket. An identification indicia is then impressed on the tabs.

In an embodiment of the invention, the identification indicia is formed in conjunction with the heat sealing step whereby the indicia is formed by means of heat seals impressed into the plastic material.

The invention further contemplates a tabulated refillable book having a looseleaf type binder with a plurality of rings positioned along a spine and levers for opening the rings. A number of the aforementioned transparent sheet protectors are supported by the rings. Individual sheets may be inserted into the protectors. The tab positions on the respective sheet protectors are sequentially indexed with respect to each other.

The aforementioned objects, features and advantages of the invention will, in part, be pointed out with particularity and will, in part, become obvious from the following more detailed description of the invention, taken in conjunction with the accompanying drawings, which forms an integral part thereof.

DESCRIPTION OF THE PREFERRED EMBODIMENT

Figure 1:
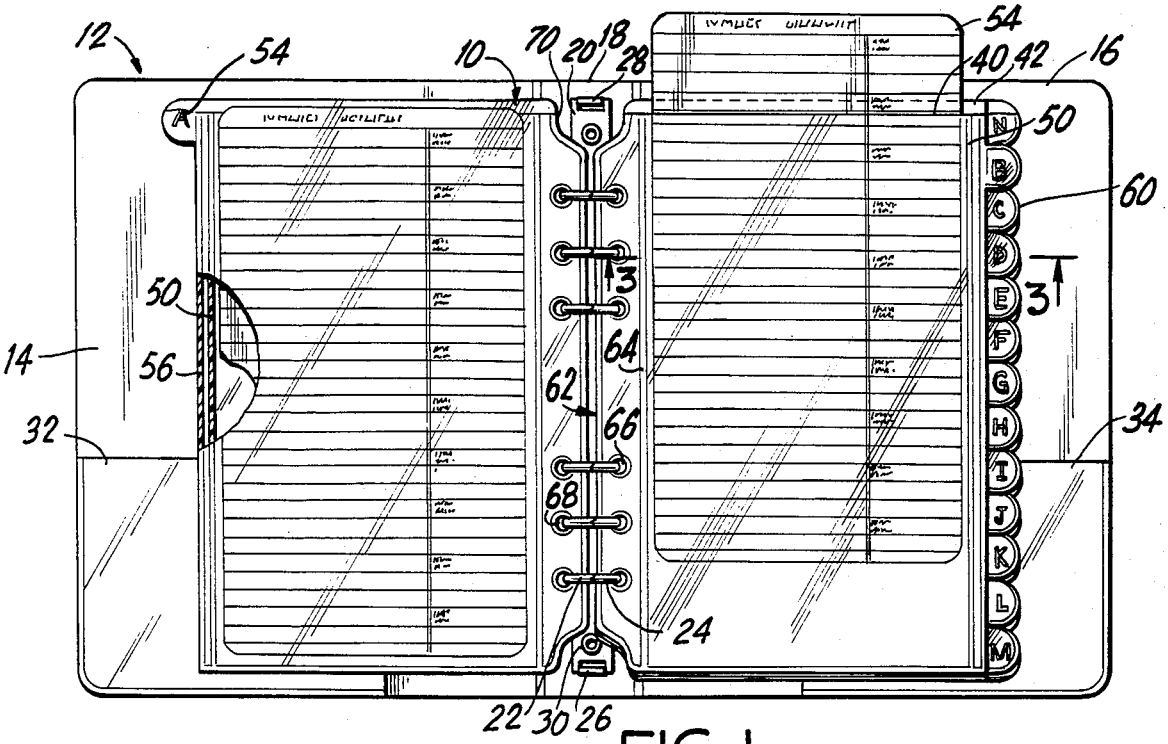
FIG. 1 is a plan view of the tabulated refillable book in an open position exposing various sheet protectors, in accordance with the present invention.

Referring now to FIG. 1, the sheet protector of the present invention is shown generally at 10 and is positioned within a looseleaf binder, shown generally at 12. The looseleaf binder is of a standard type including a front cover 14 and a rear cover 16 interconnected by a spine portion 18. Located on the spine portion is a metal bar 20 supporting a purality of rings 22 having an interfitting split section 24 to permit opening of the rings. End levers 26, 28 are available for manipulation causing a spring mechanism within the bar section 20 to open the rings, as is well known. The bar section itself is retained onto the spine by means of rivets 30.

An overlying flap 32 is formed on the lower portion of the front cover to define a storage pocket therein, and a similar overlying flap 34 is formed on the rear cover 16 to similarly define a pocket therein.

Figure 2:
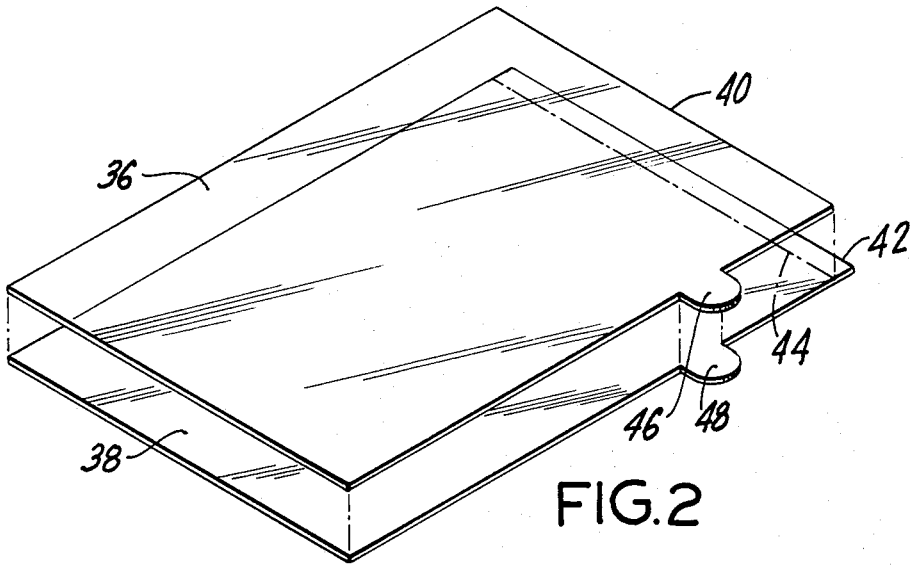
FIG. 2 is an exploded view of the upper an lower layers forming an individual sheet protector.

The particular sheet protectors are formed of upper and lower layers 36, 38, as best shown in FIG. 2. The layers are formed of substantially transparent material, typically plastic such as vinyl or the like. The layers can be formed with a clear or satin finish, as long as it permits viewing of a sheet inserted therebetween. The upper and lower layers, 36, 38 are each substantially rectangular and almost identical in shape. However, the upper layer 36 has its longitudinal dimension slightly shorter than the lower layer 38. As a result, when the two layers are placed adjacent each other, the top edge 40 of the upper layer 36 will be spaced from the top edge 42 of the lower layer 38, as shown by the dotted line 44 in FIG. 2.

Laterally extending and integral with the upper layer 36 is the tap portion 46. A correspondingly shaped tap portion 48 is formed with the lower layer 38 and integral therewith. The two layers are paired and sealed together about their periphery by typical heat sealing mechanisms. All of the peripheral edges of the layers are sealed together with the exception of the top edges 40, 42. As a result, the two layers form a pocket therebetween for receiving a sheet therein.

Figure 3:
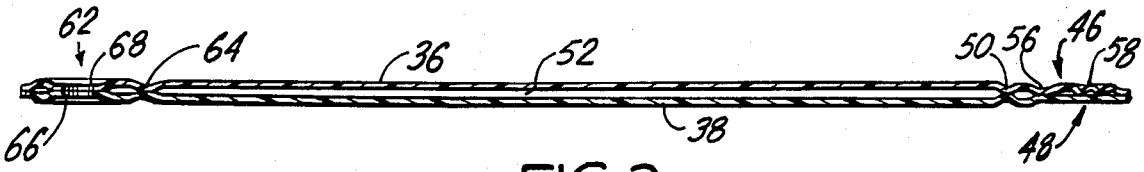
FIG. 3 is a cross sectional view taken along lines 3—3 of FIG. 1, and specifically through one sheet protector.

More specifically, as shown in FIGS. 1 and 3, the upper layer 36 and lower layer 38 are placed onto each other, and utilizing heat sealing mechanisms three of the peripheral edges are secured together. The heat sealing mechanisms forms an indent at the point of fusion, as shown typically at 50. After the three peripheral edges are sealed together, an internal pocket 52 is formed. By displacing the top edges 40, 42 of the two layers, insertion of a sheet into the pocket 52 is facilitated. This can best be seen in FIG. 1 wherein insertion of the sheet 54 is facilitated by placing it between the edges 40 and 42.

Simultaneously with the sealing of the peripheral edges of the layers 36, 38, the peripheral edges of the tab sections 46, 48 are also heat sealed together at their semicircular peripheries. Additionally, an identifying indicia can be formed into the tab section by means of the heating sealing operation. The same indents which form the heat sealing channel around the periphery of the sheets can also form sections of the identifying indicia.

Specifically, as shown in FIGS. 1 and 3, individual alphanumeric letters have been formed in the tab sections by means of the heat sealing operation. Thus, the sheet on the left portion in FIG. 1 has the identifying letter A placed in its tab portion 54. Similarly, other of the tabs have other letters of the alphabet formed therein. As shown in FIG. 3, the specific indents 56 and 58 identify the letter D in the tab section 60 shown in FIG. 1.

During the formation of the letters or other indents, a sheet of material could be interposed whereby the letters or indents could be decoratively colored. For example, a sheet of gold leaf material could be used to provide a gold tint to the letters.

In order to insert the sheets into the looseleaf binder, a selvage section 62 is formed along the inner edge of the sheet protectors. The selvage section 62 is defined by means of the heat sealing indented channel 64 separating the pocket 52 from the selvage section 62. Within the selvage section, a plurality of holes 66 are formed with the peripheries of the holes being heat sealed together at 68. By means of the heat seal operation, the hole effectively becomes reinforced so it can be securely retained within the binder rings.

In order to utilize the sheets for indexing, the particular tab locations on successive sheets can be positioned in a sequential manner. Thus, the tab bearing the letter A is placed at the top of the sheets, and the next tab bearing the letter B is placed at a location spaced in sequence from the tab bearing the letter A. Similarly, the other tabs can be positioned so as to be spaced adjacent to each other so as to permit easy identification of the indicia formed thereon.

At the opposing ends of the selvage, the sheet itself is shown to include upper and lower shoulder portions 70 so as to permit easy access to the releasing levers 26, 28. The complete periphery of the selvage section is heat sealed so that all of the edges of the entire sheet protector are closed, with the exception of the top edges which give access to the pocket.

It should be appreciated, that all of the peripheral edges of the layers could be sealed together and a separate slit opening could be formed in one of the layers to give access to the pocket. Other access could also be provided.

In the particular embodiment shown, the booklet forms a telephone directory and the particular sheets 54 which are inserted in each of the sheet protectors are ones which have preprinted room for names, addresses, and telephone numbers. However, other types of sheets could be inserted into the sheet protectors and accordingly, other types of identifying indicia could be placed on the tabs. For example, the book could be utilized as a calendar with pages insertable representing the particular months of the year. Each page would have as indicia identifying the particular month. By means of the replaceable feature of the sheets, the same book could be continuously used year after year by simply replacing the sheets having the months printed on them. Additionally, the book can be used as a recipe book, a standard index, and similar types of books requiring tabulation and refillability.

With the embodiment as described, when an additional name must be entered, the particular sheet can be extracted from the sheet protector and the name added. The sheet is then replaced into the pocket between the layers forming the sheet protector. Furthermore, extra sheet protectors could be provided without having any tab on them for extra pages between adjacent tabs. Thus, between the tab A and B, if additional names having the letter A is required, additional sheets and sheet protectors without tabs could be placed between the A and B tabs for extra names with the Letter A. The front or rear book pockets 32, 34 can be used to hold extra sheets for insertion into the sheet protectors.

In forming the particular sheet protectors, the shape of the sheets can initially be cut as shown in FIG. 2 and these sheets then inserted in the heat sealing press. Alternately, the apparatus which provides for the heat sealing can simultaneously be utilized to cut the sheets to the particular size desired so that the cutting operation and the heating sealing operation are carried out in conjunction with each other.

There has been disclosed heretofore the best embodiment of the invention presently contemplated. However, it should be understood that various changes and modifications may be made thereto without departing from the spirit of the invention.

I claim:

1. A sheet protector, comprising:

upper and lower layers of substantially transparent plastic material;

a pair of complementary tabs, each tab laterally extending from the edge of a respective layer and integrally formed therewith, each tab comprising an identification means thereon;

a heat sealed indent securing together at least a portion of the peripheries of said layers;

a separate heat sealed indent which forms said indentification means on said tabs, and opening means defining a pocket in combination with said layers, whereby a sheet may be inserted in said pocket.

2. A sheet protector as in claim 1, wherein said tabs are suitably indexed along the respective edges of said layers to identify the sheet protector by its respective tab position.

3. A sheet protector as in claim 1, wherein said layers have a satin finish to avoid reflectivity therefrom.

4. A sheet protector as in claim 1, wherein said sealing means secures together only the peripheries of said tabs.

5. A sheet protector as in claim 1, wherein said layers are substantially rectangular, said sealing means securing together three peripheral edges of said layers, and wherein the fourth edges are unsealed.

6. A sheet protector as in claim 5, wherein the fourth edges of said layers are displaced with respect to each other to facilitate insertion of a sheet between said unsealed edges.

7. A plurality of sheet protectors as in claim 1, wherein the tab positions of the respective sheet protectors are sequentially indexed with respect to each other to provide a set of position selectable sheet protectors.

8. Sheet protectors as in claim 7, wherein each tab is identified with a unique alphanumeric indicia whereby said tabs form an alphabetic index.

9. A sheet protector as in claim 1, comprising a selvage formed along one edge of said sheet protector, a heat sealed indent separating said selvage from said pocket.

10. A sheet protector as in claim 9, and comprising a plurality of holes formed through said selvage for receiving the rings of a binder, the peripheral edges of said holes being heat sealed, with the heat sealed peripheral edges of the holes forming an integral reinforcement of the holes.

11. A sheet protector as in claim 9, and comprising indented shoulders formed at the opposing ends of said selvage to accommodate release levers in the binder.

* * * * *